US007775942B2

(12) United States Patent
Hildebrandt et al.

(10) Patent No.: US 7,775,942 B2
(45) Date of Patent: Aug. 17, 2010

(54) RECUMBENT STEPPER APPARATUS

(75) Inventors: Mark Hildebrandt, Saline, MI (US); Roger Fettes, Ann Arbor, MI (US); Douglas Hennigar, Ann Arbor, MI (US); Matthew Paul Weber, Brighton, MI (US); Stephen Patrick Telesco, Dexter, MI (US); Brian Kurowicki, Adrian, MI (US)

(73) Assignee: NUSTEP, Inc., Ann Arbor, MI (US)

( * ) Notice: Subject to any disclaimer, the term of this patent is extended or adjusted under 35 U.S.C. 154(b) by 0 days.

(21) Appl. No.: 12/263,629

(22) Filed: Nov. 3, 2008

(65) Prior Publication Data

US 2009/0124467 A1 May 14, 2009

Related U.S. Application Data

(60) Provisional application No. 61/001,718, filed on Nov. 2, 2007.

(51) Int. Cl.
*A63B 22/12* (2006.01)

(52) U.S. Cl. ..... 482/62; 482/52

(58) Field of Classification Search ..... 482/51, 482/52, 53, 57, 62, 60, 63; 280/233, 232; 74/594.1

See application file for complete search history.

(56) References Cited

U.S. PATENT DOCUMENTS

| | | | | |
|---|---|---|---|---|
| 5,356,356 | A | 10/1994 | Hildebrandt et al. | |
| 5,542,893 | A * | 8/1996 | Petersen et al. | 482/72 |
| 6,042,518 | A * | 3/2000 | Hildebrandt et al. | 482/57 |
| 2002/0151415 | A1 | 10/2002 | Hildebrandt et al. | |
| 2008/0242511 | A1 * | 10/2008 | Munoz et al. | 482/5 |

OTHER PUBLICATIONS

International Search Report; PCT/US2008/082228 (mailed May 25, 2009).

* cited by examiner

*Primary Examiner*—Loan Thanh
*Assistant Examiner*—Tam Nguyen
(74) *Attorney, Agent, or Firm*—Brinks Hofer Gilson & Lione

(57) ABSTRACT

A recumbent exercise device which provides lower body, upper body and cardiovascular conditioning is disclosed. A pair of leg assemblies and a pair of arm assemblies are pivotally supported by the frame for movement about a transverse pivot axis. The arm and leg assemblies each includes an upward and forward extending lever with the leg assemblies terminating in pedals and the arm assemblies terminating in handles. The arm and leg assemblies are connected to each other for contralateral movement. A resistance mechanism is positioned substantially between the legs of a user.

13 Claims, 7 Drawing Sheets

RECUMBENT STEPPER APPARATUS

CROSS REFERENCE TO RELATED APPLICATION

This application claims priority to U.S. Provisional Patent Application 61/001,718, filed on Nov. 2, 2007, the entirety of which is hereby incorporated by reference.

BACKGROUND OF THE INVENTION

The present invention generally relates to equipment for physical therapy and/or general exercise. More particularly, this invention relates to a recumbent exercise machine which provides for the exercising and strengthening of major muscle groups in addition to cardiovascular conditioning. In so doing, the present invention includes lower body exercising coordinated with upper body exercising.

Elderly patients, patients undergoing physical therapy, obese patients, and other patients in similar circumstances, whether at home, in the hospital or in another clinical setting, have special needs when it comes to physical therapy equipment. Often, the patients have limited mobility, age related illnesses, decreased ranges of appendage movement, disabilities, low endurance and need for therapy with respect to more than one particular movement or muscle group. All of these factors must be taken into consideration when designing or providing equipment for their use.

Those people who exercise for its many health benefits, and not specifically for rehabilitation purposes, typically desire equipment which is challenging, safe, fun, effective, convenient and which provides a benefit to a multiple number of muscle groups so that a total body workout is achieved in a relatively short period of time. When the equipment is for home use, other important considerations include durability and cost.

Numerous types and varieties of physical therapy and exercise equipment are available for both clinical and home use. Of the many types, two of the most popular include the elliptical (hereinafter "ellipticals") and stationary bicycles. Each of these machines, however, has certain limitations concerning their ease of use, range of movement, safety, and the muscle groups worked.

Generally ellipticals include a pair of pedals which move up and down and back and forth, thereby crudely simulating walking or running, in response to the weight and physical effort of the patient or exerciser (hereinafter "user"). The pedals are connected to a mechanism which applies a resistance or load. This resistance is often adjustable so that the elliptical can accommodate users of various levels of physical conditioning and ability.

One limitation of ellipticals is that the user is typically required to stand during the exercise. Since the user is in an upright position, a significant amount of balance and coordination on the part of the user is required. Because of the decreased mobility and coordination, this may prevent a patient undergoing physical therapy from using the elliptical. A related limitation of the elliptical is that it requires continuous close supervision when being used by a person undergoing physical rehabilitation. Close supervision by a physical therapist or assistant is required to ensure that the patient does not collapse or otherwise lose balance and fall from the elliptical, resulting in an injury. A further limitation of the elliptical is its relative lack of exercise or conditioning of the upper body of the user. Another limitation is that ellipticals may elevate the heart rate and the blood pressure too quickly for unconditioned and elderly patients, potentially causing harm.

And finally, ellipticals usually have a fixed stride length which is not ideal for all patients, and the elliptical motion generally has significant momentum which cannot be stopped immediately by a patient in an emergency.

One limitation of a stationary bicycle is that the seat is typically a narrow saddle seat positioned above a pair of rotatable pedals having a fixed range of motion. The rotation of the pedals is resisted by a brake or other resistance mechanism. The user is required to lean forward to hold onto a set of handles, which may be stationary or movable. In order to use a stationary bicycle, the user must be capable of climbing up onto the seat and must possess sufficient strength, balance, and coordination to maintain themselves on the narrow seat while pedaling over a fixed range of motion and manipulating the handles if they are of the moveable variety. Often the elderly, obese or physical therapy patient cannot use a stationary bike because of the above requirements and further because they require constant supervision by the physical therapist to prevent possible injury to the patient upon collapse or loss of balance.

As can be seen from the above discussion, there is the need for an apparatus which allows the user to easily get on and off the apparatus with or without assistance. Furthermore, the apparatus should provide a high degree of stability and safety to the user so that the user can manipulate the machine without constant attention or supervision. Additionally, the apparatus should be adjustable to accommodate users of significantly different sizes and physical conditions while still being comfortable and ergonomically correct.

SUMMARY OF THE INVENTION

In overcoming the drawbacks and limitations of the known technology, a recumbent exercise device which provides lower body, upper body and cardiovascular conditioning is disclosed. A pair of leg assemblies and a pair of arm assemblies are pivotally supported by a frame for movement about a transverse pivot axis. The arm and leg assemblies each includes an upward and forward extending lever with the leg assemblies terminating in pedals and the arm assemblies terminating in handles. The arm and leg assemblies are connected to each other for contralateral movement.

There is also a resistance mechanism for providing resistance to the movement of the assemblies that is located generally at the forward end of the recumbent exercise device and is positioned substantially between the legs of a user. The mechanism includes a brake assembly and requires only two stages to transfer a load provided by the user to a brake assembly, making the mechanism simple and compact.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE INVENTION

Figure 1:
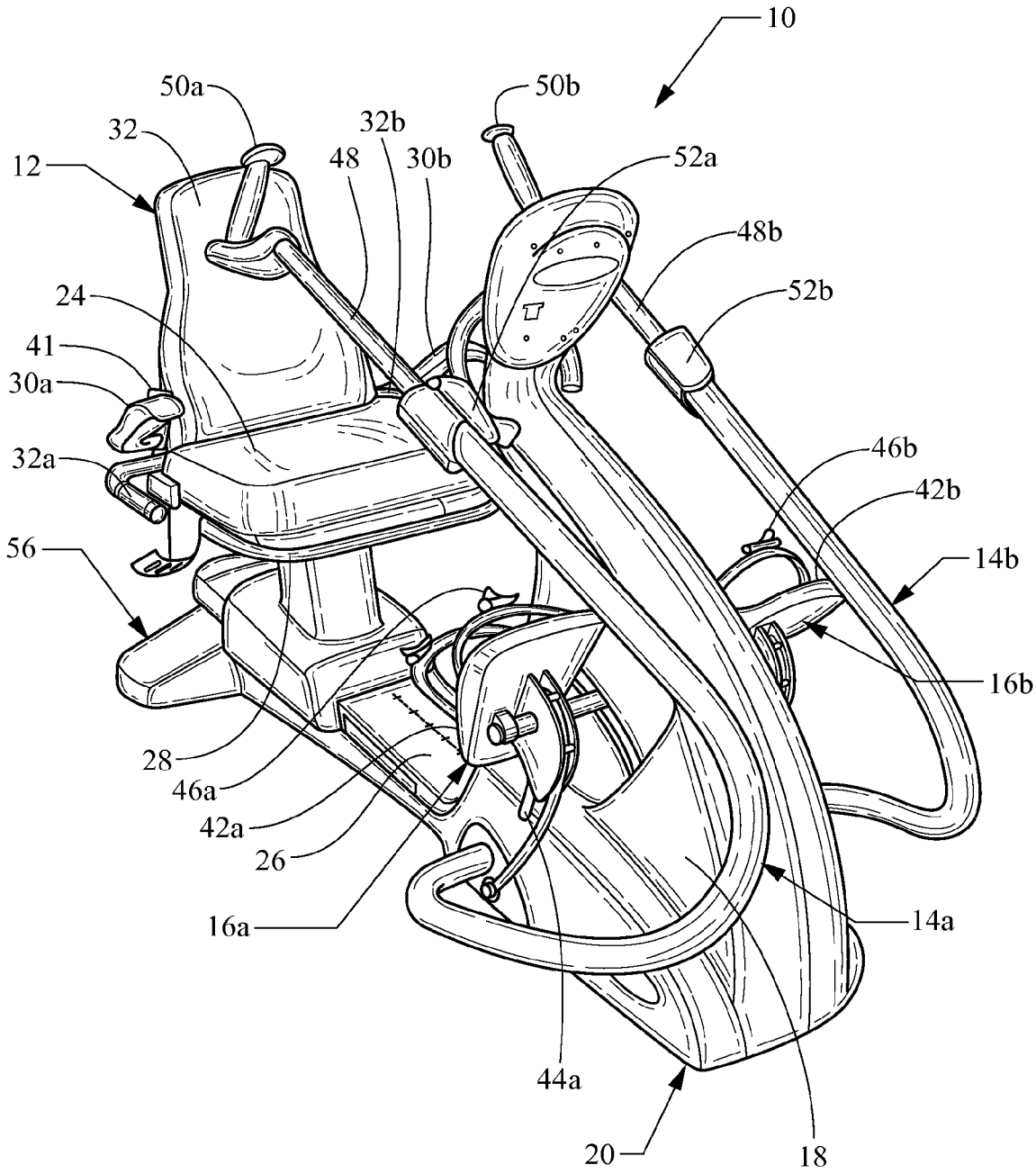
FIG. 1 is a perspective view of the recumbent stepper apparatus.
Figure 2:
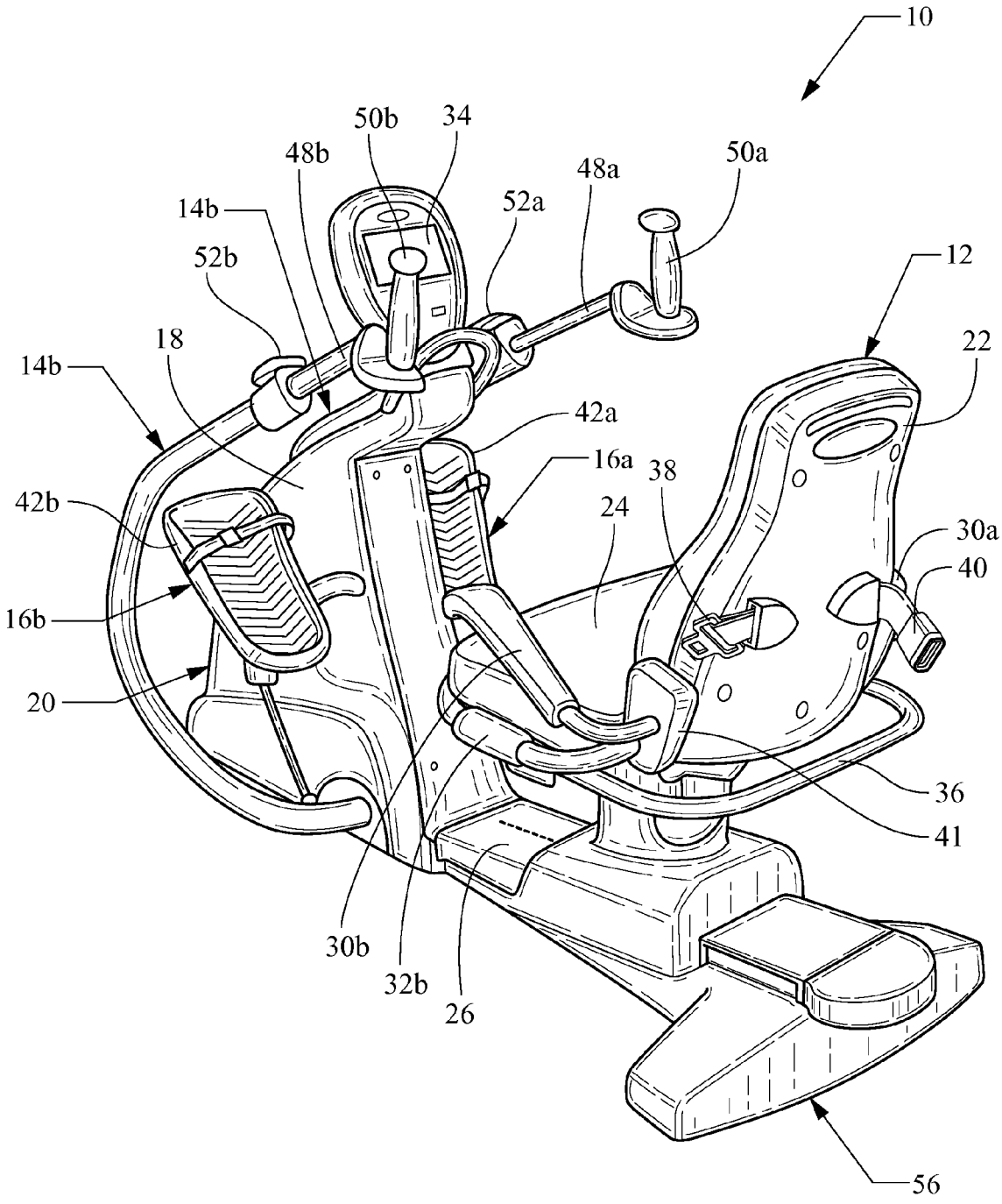
FIG. 2 is another perspective view of the recumbent stepper apparatus.
Figure 3:
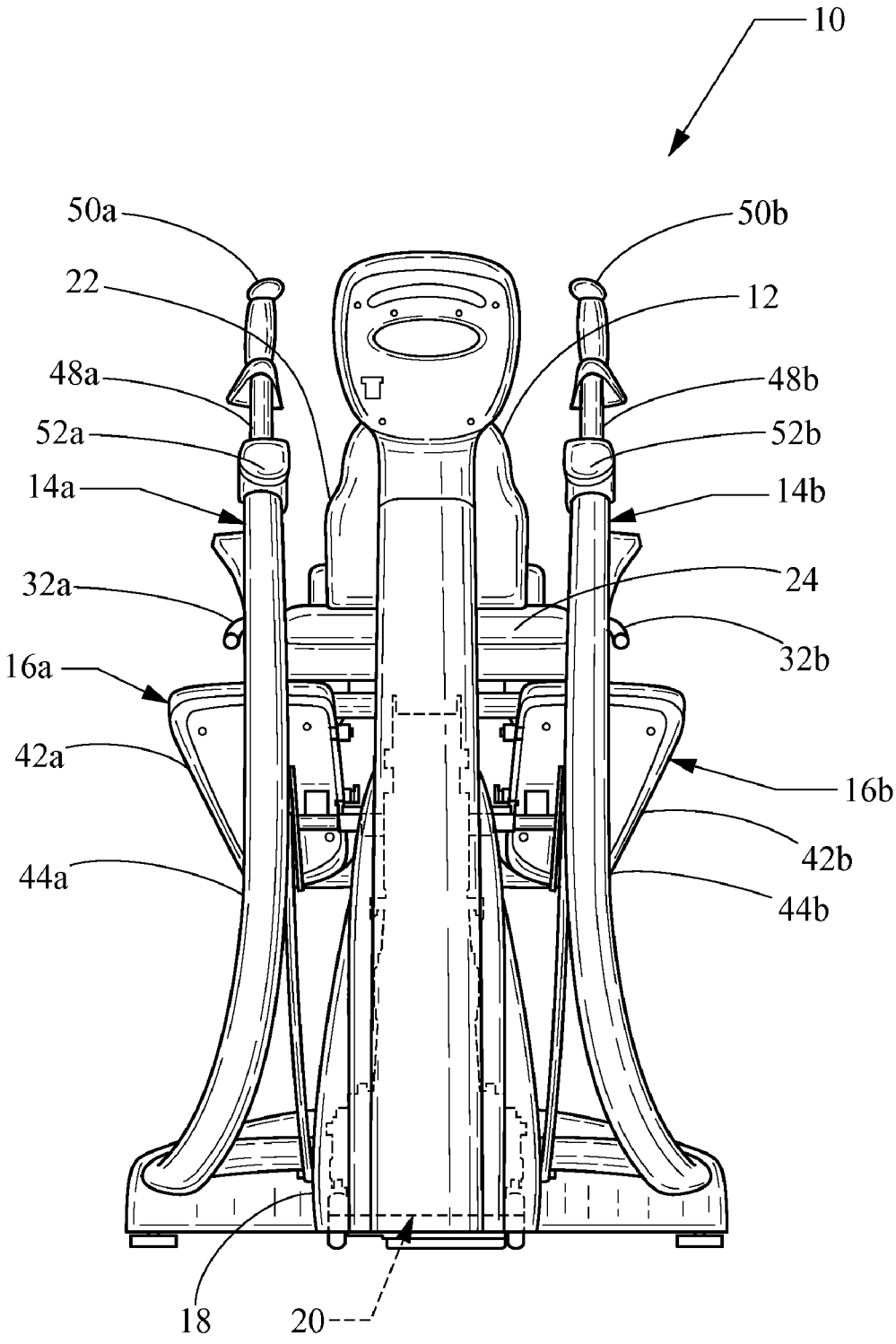
FIG. 3 is yet another perspective view of the recumbent stepper apparatus.

Referring to FIGS. 1, 2 and 3, an apparatus 10 is shown. The apparatus 10 is a total body exerciser since it strengthens or rehabilitates all of the major muscle groups while also providing for effective cardiovascular conditioning. The apparatus 10 includes a seat 12, handle bar systems 14*a* and 14*b*, pedal systems 16*a* and 16*b*, and a main housing 18, enclosing a resistance mechanism 20, which is best shown in FIGS. 4-7. The apparatus 10 is recumbent since the patient or user is generally in a reclined position when it is being used. The apparatus 10 can be referred to as a cross trainer since it exercises the legs and arms of the user through an oscillating or reciprocating movement of pedal systems 16*a* and 16*b* and handle bar systems 14*a* and 14*b* through the offering of resistance to pushing or pulling (with foot straps) of the pedal systems 16*a* and 16*b* and handle bar systems 14*a* and 14*b*. Both pushing or pulling against resistance exercises the legs and lower body of the user, and the upper body and arms. Additionally, the apparatus 10 is constructed such that the apparatus 10 can accommodate a user weighing up to about 600 pounds.

The seat 12 includes a back 22 for supporting the back of the user and a cushion 24 for supporting the bottom of the user. The back 22 is configured to recline, to accommodate a larger or heavier user. Additionally, the cushion 24 is available in a large width cushion 24, to accommodate even larger or heavier users.

The seat 12 slideably engages a track 26, which allows the seat 12 to be adjusted closer to, or farther away, from the housing 18. The position of the seat 12 can then be displayed on a display 34. In order to adjust the position of the seat, the user engages a wraparound lever 28. Another embodiment may enable wheelchair docking with the device 10. It should be noted that the track 26 has a relatively low step through height, less than about 5 inches, making it easy for a user with restricted movement to access the apparatus 10. The seat 12 may also include a stabilizer bar for receiving accessories, such as a leg stabilization device, as shown and described in U.S. patent application Ser. No. 11/544,336, the entirety of which is herein incorporated by reference.

The seat 12 as shown in FIGS. 1, 2 and 3 is an action position. More specifically, the seat is in the action position when the seat 12 is positioned as if the user was currently operating the apparatus 10. However, the seat 12 also has the ability to rotate 360 degrees, away from, and back to, the action position. The user can rotate the seat 12 by engaging a wraparound lever 36. Generally, the seat 12 can rotate about an axis substantially perpendicular to the length of the track 26. Additionally, when the seat 12 is rotated from its action position, the seat 12 contains a locking mechanism for locking the seat on the track 26, preventing the seat 12 from sliding along the track 26 when the seat 12 is rotated from its action position.

Attached to the sides of the seat are arm rests 30*a* and 30*b*. The arm rests 30*a* and 30*b* are configured to rotate on an axis substantially perpendicular to the length of the apparatus 10, so a user with restricted movement can easily access or depart from the seat 12. Near the arm rests 30*a* and 30*b*, are heart rate monitor handles 32*a* and 32*b*. Similar to the arm rests 30*a* and 30*b*, the heart rate monitor handles 32*a* and 32*b* rotate on an axis substantially perpendicular to the length of the apparatus 10, so as to accommodate various height users. They remain parallel with the seat cushion 24 to enable ingress/egress with the seat. As it is well known in the art, the heart rate monitor handles 32*a* and 32*b* can measure the heart rate of the user and report the results on the display 34, via either wired or wireless signals.

Seat belt retractors 38 and 40 are located on the back 22 of the seat 12. The seat belt retractors 38 and 40 each contain a retractable seat belt, terminating with a male and female head, respectively. The male and female heads engage on another, locking the user in place. The seat belt retractors 38 and 40 are located relatively high, i.e. away from the user's waist and near the user's chest. By so doing, the belts strap the midsection of the user to keep them upright and making it relatively easy for the user to disengage the male and female heads. Another seat belt 41 is mounted lower to hold a user more firmly against the seat back 22 and cushion 24 similar to conventional lap belts.

An accessory bag can be attached to the back 22 of the seat 12. Generally, any type of material can be used to make the accessory bag; however, it is preferable to make the accessory bag out of a breathable material. In an effort to increase breathability and visibility of items in the accessory bag, a portion of the bag, such as the top, or even the entire accessory bag, may be made out of a mesh material.

The pedal systems 16*a* and 16*b*, each include pedals 42*a* and 42*b*, respectively. The pedals 42*a* and 42*b* are relatively large in size so as to accommodate the feet of larger users. Also, it has been discovered that some larger users generally angle their feet outward, making a regular size pedal very uncomfortable. The pedals 42*a* and 42*b* are capable of accepting block adapters that occupy a portion of the surfaces of the pedals 42*a* and 42*b*. By occupying a portion of the surfaces of the pedals 42*a* and 42*b*, this places a user's foot higher, and reduces flexion on the knee. Further adding to the comfort of the user, the surfaces of the pedals 42*a* and 42*b* may be equipped with a cushion, such as an air cushion and/or other accessories on the pedal surface.

The feet of the user are retained to the pedals 42*a* and 42*b* by way of retaining belts 46*a* and, respectively. The retaining belts 46*a* and 46*b* use a ratcheting system having a release lever; however, any type of suitable retaining means may be utilized.

The pedals 42*a* and 42*b* are pivotably connected to pedal systems 16*a* and 16*b*. The pedals 42*a* and 42*b* have an axis of rotation that is substantially perpendicular to the length of the apparatus 10. The pedals 42*a* and 42*b* can pivot freely across a defined range of motion or can be locked into one, of at least two positions, by engaging handles 44*a* and 44*b*, respectively.

The handle bar systems 14*a* and 14*b* both include upper extensions 48*a* and 48*b* and lower extensions. Handles 50*a* and 50*b* are slidably received in the lower extensions, respectively. The handles 50*a* and 50*b* can be adjusted in length or rotated and, for this reason, locking levers 52*a* and 52*b* are provided on the lower extensions to secure them at the desired length. The ends of the handles 50*a* and 50*b* are generally bent upward and inward relative to the remainder of the handles 50*a* and 50*b* and are provided with padded grips for multiple hand position locations. The handles 50*a* and 50*b* may further include a plurality of locking grooves for engaging a gripping aid device, such as shown and described U.S. patent application Ser. No. 11/299,492, the contents of which is herein incorporated by reference.

The handle bar systems 14*a* and 14*b* and, more specifically, the upper extensions 48*a* and 48*b*, generally form a "V" shaped pattern, with the apex of the "V" away from the seat 12. By shaping the upper extensions 48*a* and 48*b* to form a "V", the distance between the handles 50*a* and 50*b* increases as the handles 50*a* and 50*b* are extended in length, so as to more readily accommodate larger users. So, the width between the handles 50*a* and 50*b* adjusts narrower or wider based on the distance the upper extensions 48*a* and 48*b* are extended.

Figure 4:
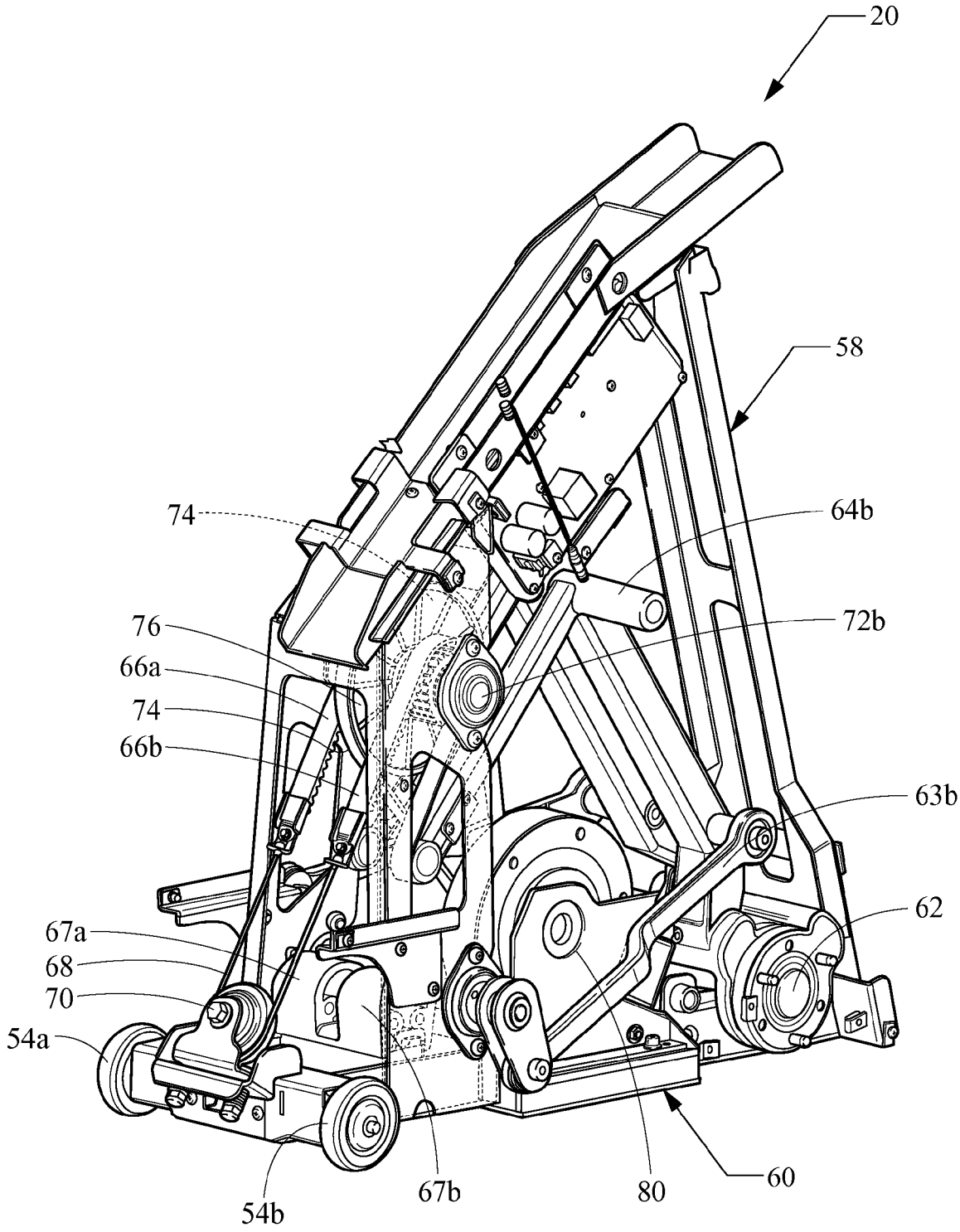
FIG. 4 is a perspective view of a resistance mechanism of the recumbent stepper apparatus.
Figure 5:
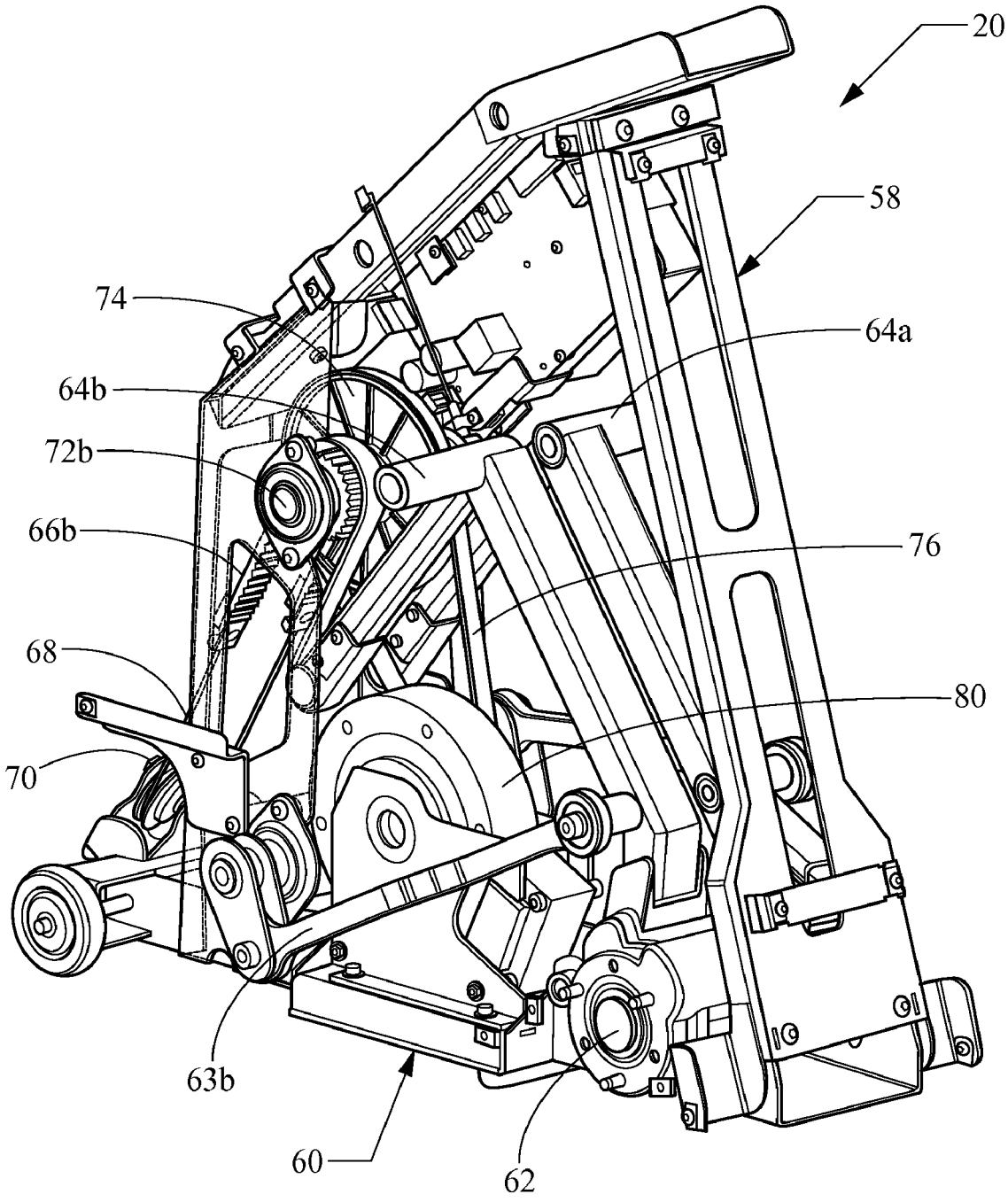
FIG. 5 is another perspective view of the resistance mechanism of the recumbent stepper apparatus.
Figure 6:
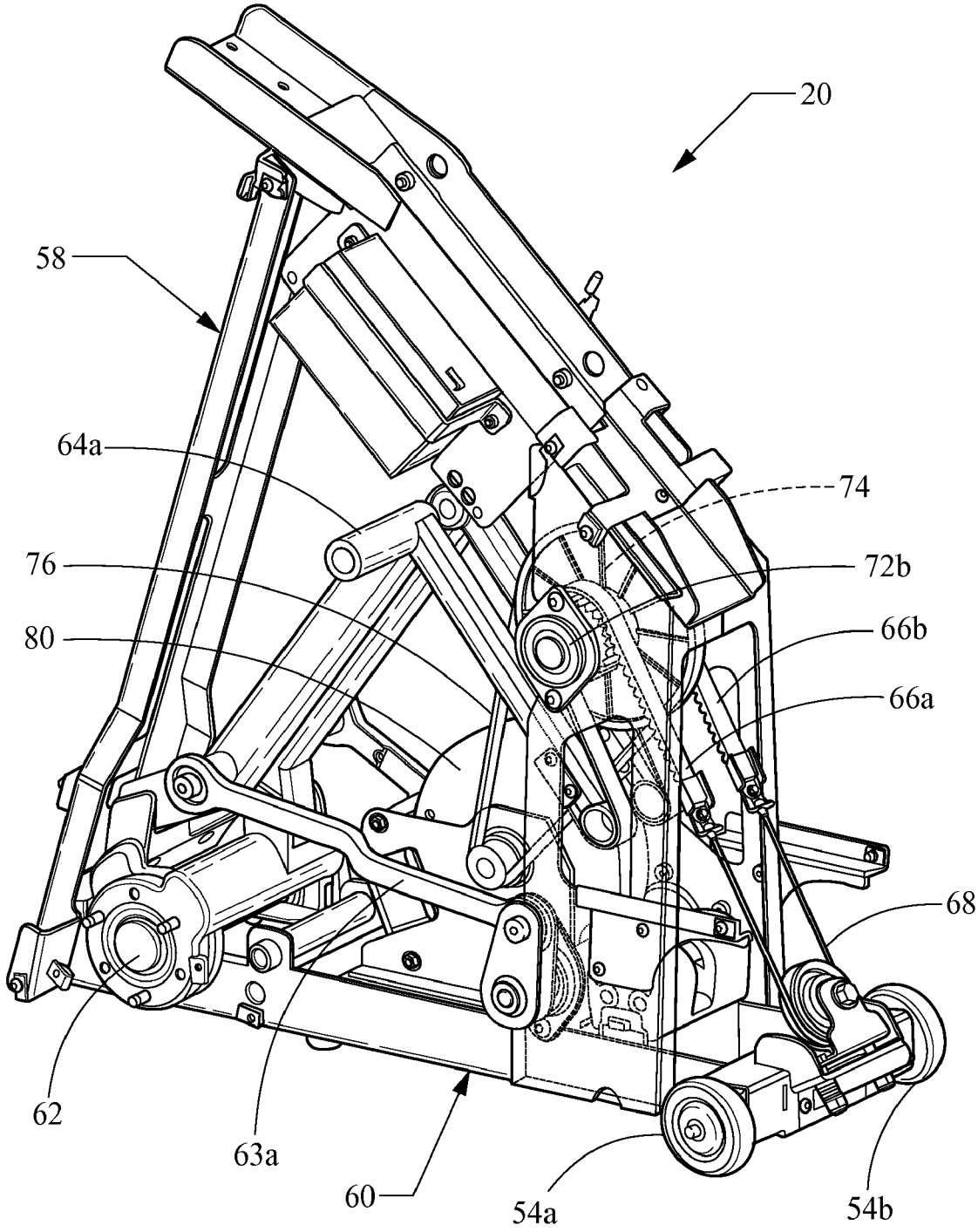
FIG. 6 is yet another perspective view of the resistance mechanism of the recumbent stepper apparatus.
Figure 7:
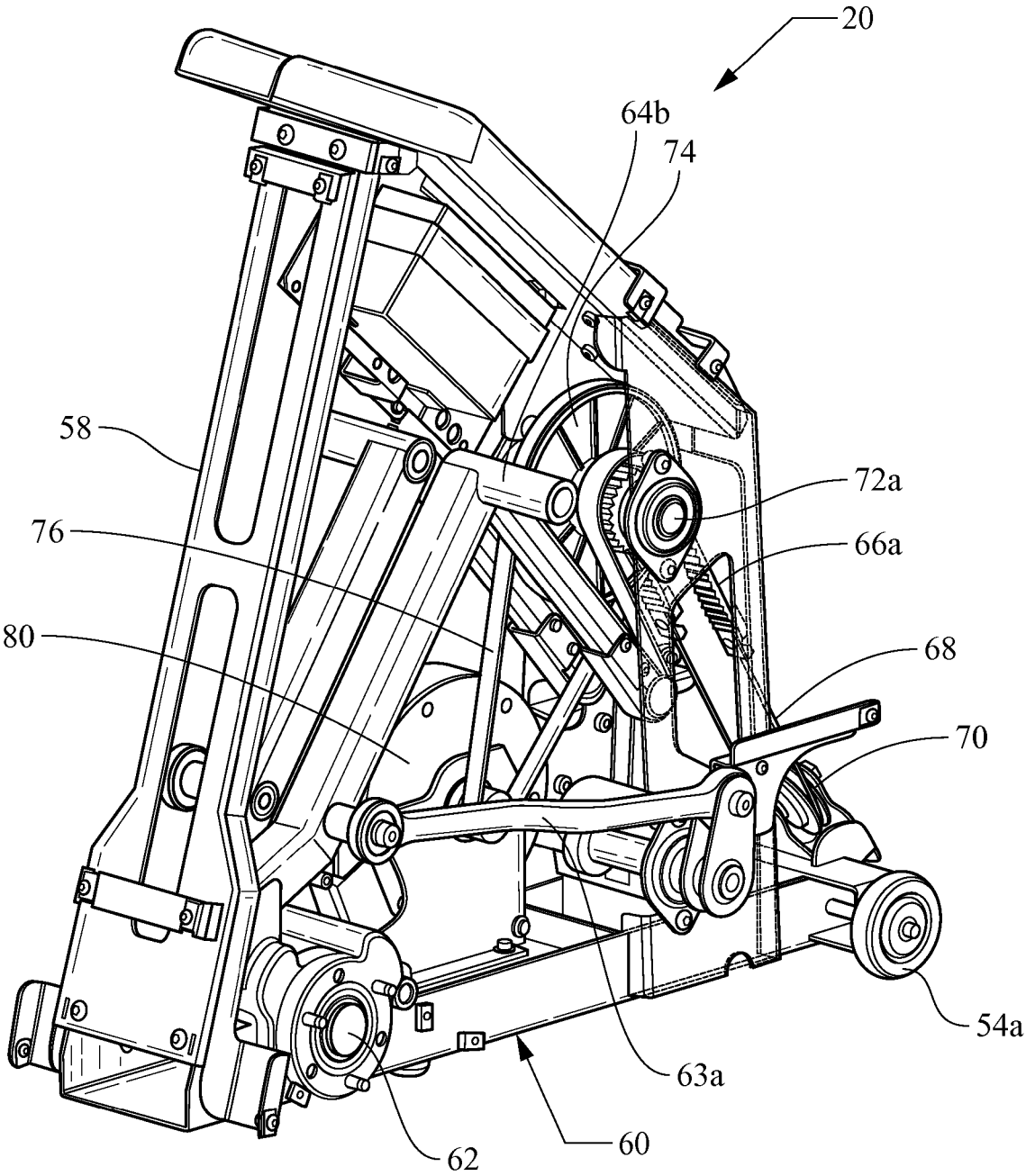
FIG. 7 is still yet another perspective view of the resistance mechanism of the recumbent stepper apparatus.

Referring to FIGS. 1 and 4, the apparatus 10 includes wheels 54*a* and 54*b* (shown in FIG. 4), located under the housing 18, opposite of the seat 12. With the apparatus 10 situated on a flat surface, the wheels 54*a* and 54*b* are two points out of four contacts with the flat surface. However, a specialized dolly can engage a back portion 56 of the apparatus 10, lifting the back portion 56 off the flat surface. As the back portion of the apparatus 10 is listed off the flat surface, the wheels 56*a* and 56*b* rotate thereby making the apparatus 10 highly portable.

Referring to FIGS. 4-7, a more detailed view of the resistance mechanism system 20, which, as previously stated, is enclosed by housing 18. The mechanism 20 is supported in part by a frame 58 and a base 60. A central pivot 62 provides the pivot axis wherein the handle bar systems 14*a* and 14*b*, and pedal systems 16*a* and 16*b* rotate from. The handle bar systems 14*a* is rigidly coupled to the pedal system 16*b* and the handle bar system 14*b* is rigidly coupled to pedal the system 16*a* for contralateral motion about the central pivot 62. This rigid coupling will cause the handle bar system 14*a* and the pedal system 16*b* (forming a first assembly) and the handle bar system 14*b* and the pedal system 16*a* (forming a second assembly) to move together. It should be noted that the pedal systems 16*a* and 16*b* are further supported by stabilizer bars 63*a* and 63*b*, respectively. By so doing, portions of the load can be removed from the central pivot 62, extending the operating life of the mechanism 20.

The handle bar system 14*a* and the pedal system 16*b* drive an arm 64*a*, while the handle bar system 14*b* and the pedal system 16*a* drive an arm 64*b*. The arms 64*a* and 64*b*, rotate about the central pivot 62, and engage belts 66*a* and 66*b*, respectively. The belts 66*a* and 66*b* are connected to each other via a cable 68, which engaged a pulley 70. The belts 66*a* and 66*b* engage one way clutches 72*a* and 72*b*, respectively. Bumpers 67*a* and 67*b* may be positioned on the base 60, so as to absorb the motion of the arms 64*a* and 64*b*, respectively. By so doing, the bumpers 67*a* and 67*b* provide a soft, low impact, fluid return motion.

The one way clutches 72*a* and 72*b*, are connected to and drive a main pulley 74. The main pulley 74 then drives a main pulley belt 76, which transfers the load to the brake assembly 80, which provides the resistance. The resistance provided by the brake assembly 80 can be adjusted so as to provide more or less resistance to the user.

Essentially, the mechanism 20 only requires two stages to transfer a load provided by the user to the brake assembly 80. The first stage transfers load to the main pulley 74 from the arms 64*a* and 64*b* via the belts 66*a* and 66*b*, which engage one way pulleys 72*a* and 72*b*, respectively. The second stage transfers load from the main pulley 74 to the brake assembly 80 via the main pulley belt 76, which is connected to the brake assembly 80. Additionally, the entire mechanism 20 is compact, so as to fit between the legs of the user, but durable enough to withstand significant loads for long periods of time.

The foregoing description of the embodiment of the invention has been presented for purposes of illustration and description. It is not intended to be exhaustive or to limit the invention to the precise embodiment disclosed. Numerous modifications or variations are possible in light of the above teaching. The embodiment discussed was chosen and described to provide the best illustration of the principles of the invention in its practical application to thereby enable one of ordinary skill in the art to utilize the invention in various embodiments and with various modifications as are suited to the particulate use contemplated. All such modifications and variations are within the scope of the invention as determined by the appended claims when interpreted in accordance with the breadth to which they are fairly, legally, and equitably entitled.

The invention claimed is:

1. A recumbent system for exercise and physical therapy, the system comprising:

a frame having a forward end and a rearward end along a longitudinal axis;

a removable seat disposed on the frame a left arm assembly and a right arm assembly, the arm assemblies supported by the frame for pivoting movement about a central pivot axis that is perpendicular to the longitudinal axis, the arm assemblies each including an upwardly extending arm lever, having an upper extension and a lower extension, terminating in a handle;

a left leg assembly and a right leg assembly, the leg assemblies supported by the frame for pivoting movement about the central pivot axis, the leg assemblies each including an upwardly extending leg lever terminating in a pedal;

the left leg assembly being rigidly coupled to the right arm assembly enabling movement of the left leg assembly and the right arm assembly together and defining a first connected assembly, the right leg assembly being rigidly coupled to the left arm assembly enabling movement of the right leg assembly and the left arm assembly together and defining a second connected assembly;

a resistance mechanism, wherein a majority of the resistance mechanism is positioned forward of the central pivot axis and between a portion of the arm assemblies, the resistance mechanism being in mechanical communication with the first and second connected assemblies and configured to provide a resistance to the first and second connected assemblies.

2. The system of claim 1, wherein the resistance mechanism comprises:

a brake assembly that is coupled to the first and second connected assemblies.

3. The system of claim 2, wherein the resistance mechanism further comprises a first belt connecting a first pulley to the brake assembly.

4. The system of claim 3, wherein the resistance mechanism further comprises:

a one way clutch connected to the first pulley, the one way clutch configured to rotate the first pulley when rotated; and a second belt connected to the first and second connected assemblies, the second belt engaging the one way clutch, whereby the second belt rotates the one way clutch when at least one of the first and second connected assemblies are engaged by the user.

5. The system of claim 1, further comprising:

a track attached to the frame; and the seat slideably attached to the track, whereby the seat can be repositioned by adjusting the seat along the length of the track or the seat can be removed entirely from the track.

6. The system of claim 5, wherein the seat further comprises a seat release allowing the seat to rotate.

7. The system of claim 5, further comprising first and second heart rate monitor handles located on opposing sides of the seat for measuring the heart rate of the user, the first and second heart rate monitor handles being rotatable about an axis perpendicular to the length of the track.

8. The system of claim 7, further comprising a display for displaying the position of the seat along the track and/or the heart rate of the user.

9. The system of claim 1, wherein the arm levers extend upward and forward from the central pivot axis and then extend rearward generally toward the seat before terminating in the handles.

10. The system of claim 1, wherein the handles are adjustable with respect to their positioning relative to the seat and the lower extensions of the arm levers.

11. The system of claim 1, wherein the width between the upper extensions adjusts narrower or wider based on the distance the upper extensions are extended from the lower extensions.

12. The system of claim 1, wherein each arm assembly includes an arm lock mechanism for unlocking or locking the upper extensions to allow the upper extensions to be lengthened, shortened or rotated about their respective lower extensions.

13. The system of claim 1, wherein the pedals can each be either locked into position or can pivot freely across a defined range of motion.

* * * * *